US007845817B1

(12) United States Patent
Miller

(10) Patent No.: US 7,845,817 B1
(45) Date of Patent: Dec. 7, 2010

(54) STROBE LIGHT FOR FIREARM

(76) Inventor: Brandon Taylor Miller, 11235 Artwood Rd., Foley, AL (US) 36536

( * ) Notice: Subject to any disclaimer, the term of this patent is extended or adjusted under 35 U.S.C. 154(b) by 224 days.

(21) Appl. No.: 12/288,408

(22) Filed: Oct. 21, 2008

Related U.S. Application Data

(63) Continuation-in-part of application No. 11/519,138, filed on Sep. 11, 2006, now abandoned.

(51) Int. Cl.
*F41G 1/34* (2006.01)

(52) U.S. Cl. ..... 362/110; 362/114; 42/146; 42/132

(58) Field of Classification Search ..... 362/110–114; 42/146, 132, 117
See application file for complete search history.

(56) References Cited

U.S. PATENT DOCUMENTS 4,060,372 A 11/1977 Beck et al.
4,486,807 A 12/1984 Yanez
5,072,342 A 12/1991 Minovitch
5,119,576 A 6/1992 Erning
5,243,894 A 9/1993 Minovitch
5,641,222 A 6/1997 Minovitch
5,641,284 A 6/1997 Minovitch
7,264,369 B1 9/2007 Howe
2005/0153262 A1* 7/2005 Kendir ..... 434/21

* cited by examiner

*Primary Examiner*—Bao Q Truong
(74) *Attorney, Agent, or Firm*—George L. Williamson

(57) ABSTRACT

Apparatus and method discloses a pair of strobe lights which are mounted onto the front of a firearm so that the lights send a light beam toward the target. The strobe lights comprise a red and a blue alternately flashing, high lumen, light-emitting diode for emitting a bright, alternating, red/blue light beam which prevents the target from properly focusing his eyes because of the alternating red and blue beams which affect the target's eyes. The lights are powered by a power supply and are controlled by a switch which is activated by the hand of a user.

16 Claims, 2 Drawing Sheets

STROBE LIGHT FOR FIREARM

RELATED APPLICATIONS

This application is a continuation-in-part of U.S. patent application Ser. No. 11/519,138 filed on Sep. 11, 2006 now abandoned.

BACKGROUND OF THE INVENTION

1. Field of the Invention

The present invention generally relates to weapons and, more particularly, is concerned with a strobe light for a handgun or long gun.

2. Description of the Prior Art

Lights for guns have been described in the prior art. However, none of the prior art discloses the unique features of the present invention.

U.S. Pat. No. 5,243,894, dated Sep. 14, 1993, to Minovitch disclosed a light gun. U.S. Pat. No. 5,072,342 dated Dec. 10, 1991, to Minovitch disclosed a light gun. U.S. Pat. No. 4,060,372 dated Nov. 29, 1977 to Beck, et al., disclosed a self-defense apparatus comprising flashcube light source. U.S. Pat. No. 4,486,807 dated Dec. 4, 1984 to Yanez disclosed a non-lethal, self-defense device. U.S. Pat. No. 5,119,576 dated Jun. 9, 1992 to Erning disclosed a firearm with separable radiation-emitting attachment. U.S. Pat. No. 5,641,222 dated Jun. 24, 1997 to Minovitch disclosed a light gun. U.S. Pat. No. 5,641,284 dated Jun. 24, 1997 to Minovitch disclosed a flash bulb cartridge for light guns.

While these lights related to guns may be suitable for the purposes in which they were designed, they would not be suitable for the purposes of the present invention as hereinafter described.

SUMMARY OF THE PRESENT INVENTION

The present invention discloses a pair of strobe lights which are mounted onto the front of a firearm so that the lights send a light beam toward the target. The strobe lights comprise a red and a blue alternately flashing, high lumen, light-emitting diode for emitting a bright, alternating, red/blue light beam which prevents the target from properly focusing his eyes because of the alternating red and blue beams which affect the target's eyes. The lights are powered by a power supply and are controlled by a switch which is activated by the hand of a user.

An object of the present invention is to provide a strobe light for mounting onto a firearm in a simple and easy manner. A further object of the present invention is to provide a strobe light for use with a firearm which will temporarily interfere with the eyesight of a target in order to provide protection to the user of the present invention. A further object of the present invention is to provide a strobe light for a weapon which can be easily and relatively inexpensively manufactured.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
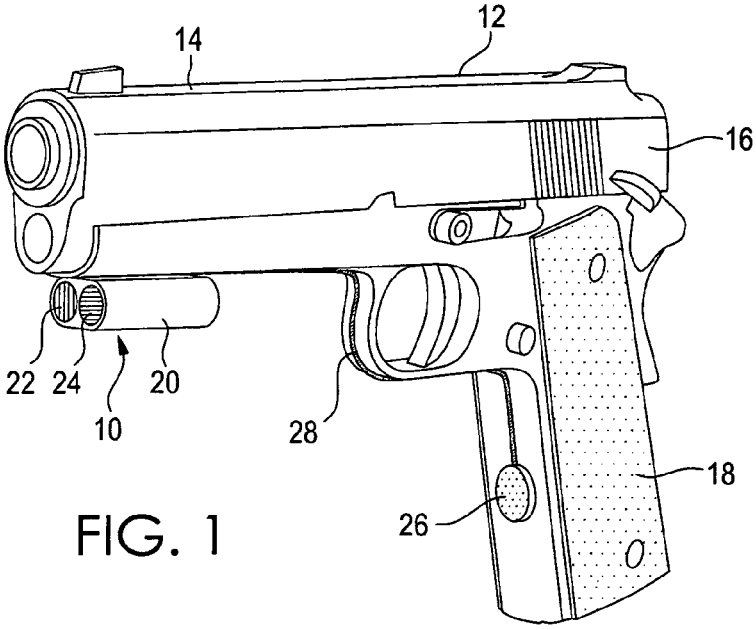
FIG. 1 is a perspective view of the present invention.

With regard to reference numerals used, the following numbering is used throughout the drawings.

10 present invention
12 firearm
14 barrel
16 receiver
18 handle
20 housing
22 red light
24 blue light
26 switch
28 electrical wiring
30 light beams
32 power supply

DETAILED DESCRIPTION OF THE PREFERRED EMBODIMENT

The following discussion describes in detail at least one embodiment of the present invention. This discussion should not be construed, however, as limiting the invention to those particular embodiments since practitioners skilled in the art will recognize numerous other embodiments as well. For a definition of the complete scope of the invention, the reader is directed to the appended claims. FIGS. 1 through 6 illustrate the present invention wherein a strobe light for use on a firearm is disclosed.

Turning to FIG. 1, shown therein is a perspective view of the present invention 10 mounted on a firearm 12 being a handgun. The handgun 12 comprises a barrel 14, a receiver 16 and a handle 18 which is grasped by the user. It can be seen that the present invention 10 is mounted on the front of the handgun 12 underneath the barrel 14 and comprises a housing 20 having means for a red light 22 (vertical lines) and a blue light 24 (horizontal lines) mounted adjacent each other having a pressure sensitive switch 26 mounted on the front part of the handle so that the switch can be activated by the fingers of a user and having electrical wiring 28 connecting the lights 22, 24 to the switch 26. A power supply (not shown, see FIG. 4) would be provided in the housing 20 or the pressure switch 26 or elsewhere to provide power to the present invention 10.

Figure 2:
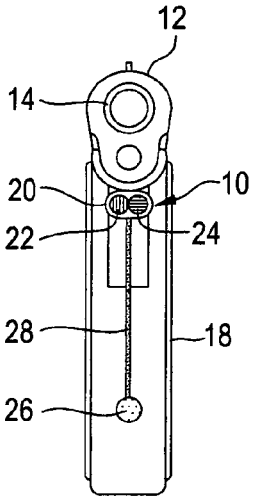
FIG. 2 is a front elevation view of the present invention.

Turning to FIG. 2, shown therein is the present invention 10 mounted on a handgun 12. Shown is the handgun 12, barrel 14, and a handle 18 which is grasped by the user. It can be seen that the present invention 10 is mounted on the front of the handgun 12 underneath the barrel 14 and comprises a housing 20 having a red light 22 and a blue light 24 mounted adjacent each other having a pressure switch 26 mounted on the front part of the handle so that the switch can be activated by the fingers of a user and having electrical wiring 28 connecting the lights 22, 24 to the switch 26. A power supply (not shown, see FIG. 4) would be provided in the housing 20 or the pressure switch 26 or elsewhere to provide power to the present invention 10.

Figure 3:
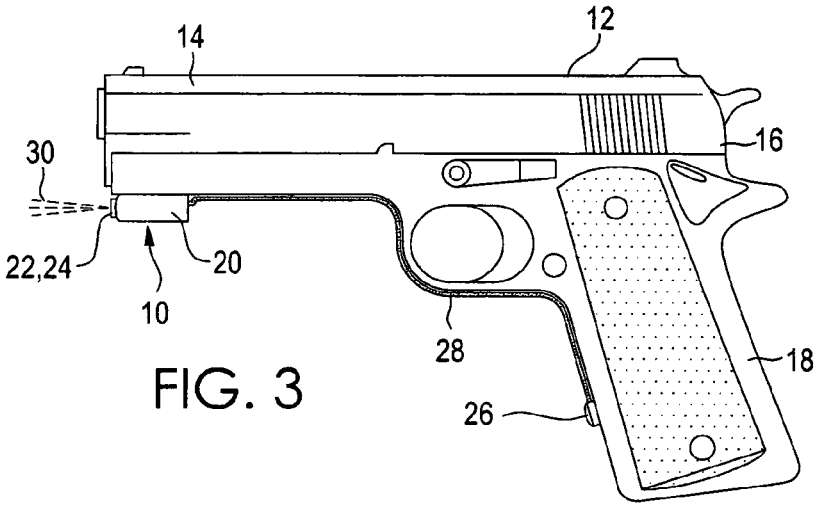
FIG. 3 is a side elevation view of the present invention.

Turning to FIG. 3, shown therein is the present invention 10 mounted on a handgun 12. The handgun 12 comprises a barrel 14, a receiver 16 and a handle 18 which is grasped by the user. It can be seen that the present invention 10 is mounted on the front of the handgun 12 underneath the barrel 14 and comprises a housing 20 having a red light 22 and a blue light 24 mounted adjacent each other for emitting light beams 30 having a pressure switch 26 mounted on the front part of the handle so that the switch can be activated by the fingers of a user and having electrical wiring 28 connecting the lights 22, 24 to the switch 26. A power supply (not shown, see FIG. 4) would be provided in the housing 20 or the pressure switch 26 or elsewhere to provide power to the present invention 10.

Figure 4:
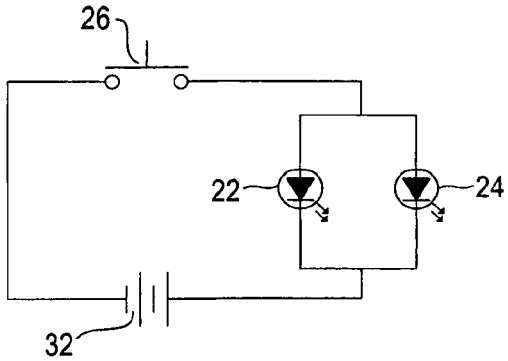
FIG. 4 is an electrical schematic of the present invention.

Turning to FIG. 4, therein is shown an exemplary electrical schematic of the present invention 10 showing the switch 26, lights 22, 24 and power supply 32. This circuit provides an alternating red and blue light beams 30 which prevent the target from properly focusing his eyes because the alternating beams flash effectively so as to have a negative affect on the eyes of a target.

Figure 5:
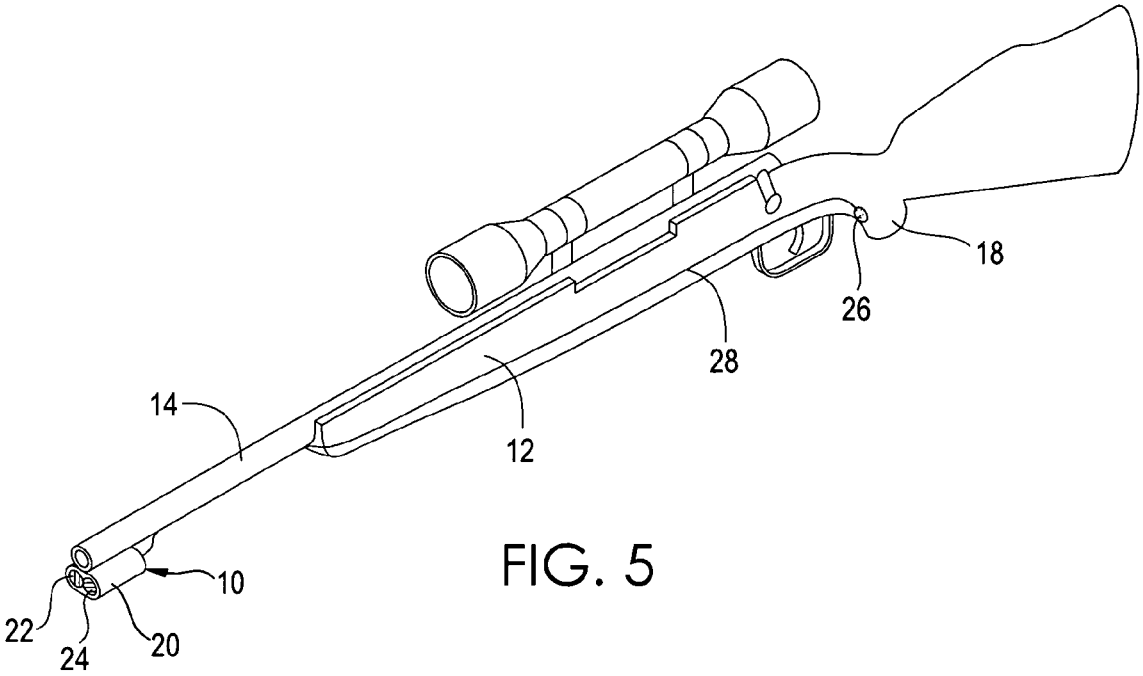
FIG. 5 is a perspective view of the present invention mounted on a rifle.

Turning to FIG. 5, therein is shown the present invention 10 mounted on the barrel 14 of firearm or rifle 12 along with handle 18, housing 20, lights 22, 24, switch 26 and wiring 28.

Figure 6:
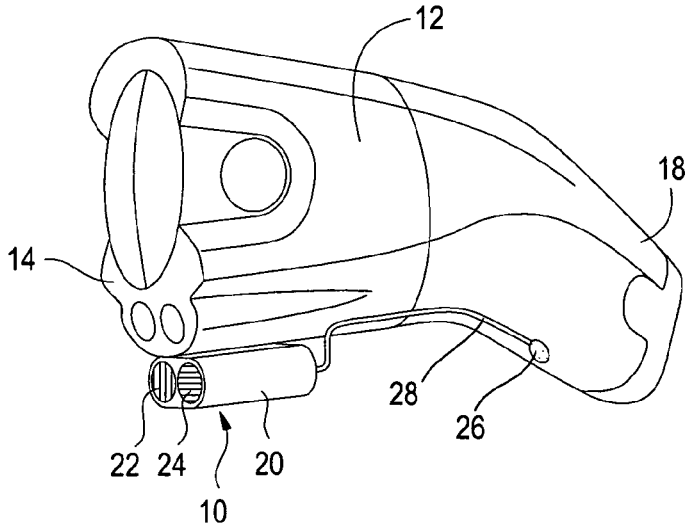
FIG. 6 is a perspective view of the present invention mounted on an alternative gun.

Turning to FIG. 6, therein is shown the present invention 10 mounted on the barrel 14 of firearm or gun 12 along with handle 18, housing 20, lights 22, 24, switch 26 and wiring 28. Firearm 12 is an illustration of a TASER which is a gun that fires electrified darts to stun and immobilize a person.

In practice, the present invention 10 is designed for law enforcement, government, military and security personnel. The present invention 10 would provide a user with a visual and psychological advantage over a target receptor. The present invention 10 is designed for use in dark or low light environments. The present invention 10 comprises a pair of strobing, high lumen, light-emitting diodes 22, 24 for emitting bright, alternating red and blue light beams 30. The alternating red and blue light beams 30 would prevent the target from properly focusing his eyes because the alternating beams flash effectively so as to have a negative affect on the eyes of a target. The present invention 10 may be manufactured and supplied as a separate apparatus for attachment to a pre-existing weapon, or, manufactured as an integral part of a weapon during the original manufacturing process. The present invention 10 may be used on handguns, long guns, rifles, shotguns and all other types of firearms.

I claim:

1. An apparatus for providing lights, the apparatus being mountable onto a firearm, the firearm having a barrel, a receiver, and a handle comprising:

a) a housing disposed on the barrel of the firearm;

b) means for a red light and a blue light being disposed in said housing, whereby the red and blue lights flash alternately being effective to have a negative affect on the eyes of a target; and, c) means for receiving and applying a potential to said means for a red light and a blue light whereby the red and blue light means can be powered.

2. The apparatus of claim 1, wherein said means for a red light and a blue light each comprise a light-emitting diode.

3. The apparatus of claim 2, wherein said means for receiving and applying a potential comprises a battery.

4. The apparatus of claim 3, further comprising a pressure switch disposed on the handle of the firearm for controlling said means for a red light and a blue light.

5. The apparatus of claim 4, wherein said red and blue lights are strobe lights.

6. A method for providing lights for being mounted onto a firearm, the firearm having a barrel, a receiver, and a handle comprising the steps of:

a) providing a housing;

b) mounting the housing onto the front of the firearm;

c) providing a red light and a blue light in the housing wherein the red and blue lights flash alternately being effective to have a negative effect on the eyes of a target; and, d) applying a potential to the red light and the blue light, wherein the red and blue lights can be powered.

7. The method of claim 6, wherein the red light and blue light each comprise a light-emitting diode.

8. The method of claim 7, further comprising the step of applying the potential to the red and blue lights by using a battery.

9. The method of claim 8, further comprising the step of providing a switch for controlling the red and blue lights.

10. The method of claim 9, wherein the red and blue lights are strobe lights.

11. The apparatus of claim 1, wherein said housing is disposed on the front of the barrel of a rifle.

12. The method of claim 6, wherein the housing is mounted onto the front of the barrel of a rifle.

13. The apparatus of claim 1, wherein said housing is disposed on the front of the barrel of a gun that fires electrified darts to stun and immobilize a person.

14. The method of claim 6, wherein the housing is mounted onto the front of the barrel of a gun that fires electrified darts to stun and immobilize a person.

15. The apparatus of claim 1, wherein said housing is disposed on the front of the barrel of a handgun.

16. The method of claim 6, wherein the housing is mounted onto the front of the barrel of a handgun.

* * * * *